US007181926B2

(12) United States Patent
Bhatia et al.

(10) Patent No.: US 7,181,926 B2
(45) Date of Patent: Feb. 27, 2007

(54) OIL SEPARATOR AND MUFFLER STRUCTURE

(75) Inventors: Kanwal Bhatia, Troy, MI (US); Michael G. Theodore, Jr., Plymouth, MI (US); Kastriot Shaska, Waterford, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 120 days.

(21) Appl. No.: 11/134,908

(22) Filed: May 23, 2005

(65) Prior Publication Data

US 2006/0260340 A1 Nov. 23, 2006

(51) Int. Cl.
*F04B 39/02* (2006.01)

(52) U.S. Cl. ..... 62/296; 62/470; 181/403; 417/312

(58) Field of Classification Search ..... 62/296, 62/469–470; 181/403; 417/312
See application file for complete search history.

(56) References Cited

U.S. PATENT DOCUMENTS

| | | | | |
|---|---|---|---|---|
| 1,405,259 | A | 1/1922 | Beach | |
| 4,381,651 | A | 5/1983 | Kubo et al. | |
| 4,401,418 | A | 8/1983 | Fritchman | |
| 4,516,916 | A | 5/1985 | English et al. | |
| 4,582,468 | A | 4/1986 | Bar | |
| 4,960,368 | A | 10/1990 | Lilie | |
| 5,214,937 | A * | 6/1993 | Henrichs et al. | 62/468 |
| 5,645,405 | A | 7/1997 | Ota et al. | |
| 5,988,990 | A | 11/1999 | Lee | |
| 6,149,397 | A | 11/2000 | Mizutani et al. | |
| 6,213,732 | B1 * | 4/2001 | Fujio | 417/312 |
| 6,511,297 | B2 | 1/2003 | Ota et al. | |

FOREIGN PATENT DOCUMENTS

| | | | |
|---|---|---|---|
| EP | 0926341 | A2 | 6/1999 |
| EP | 0940581 | A2 | 9/1999 |
| EP | 1033492 | A1 | 9/2000 |
| WO | WO01/36823 | A1 | 5/2001 |
| WO | WO02/053913 | A1 | 7/2002 |

* cited by examiner

*Primary Examiner*—William E Tapolcai
(74) *Attorney, Agent, or Firm*—Brinks Hofer Gilson & Lione

(57) ABSTRACT

An oil separator-muffler for a compressor includes an inner chamber with an oil accumulation region and a wall positioned in the inner chamber. The wall defines a separator region and has an impingement surface. The arrangement of the wall in the inner chamber defines flow channels of varying cross-sectional areas. A mixture inlet for the separator-muffler provides a passageway for an oil gaseous refrigerant mixture to flow from the exterior of the separator-muffler into the separator region. The oil is separated from the mixture as the mixture impinges against the impingement surface and flows into the oil accumulation region. A channel in fluid communication with the oil accumulation region provides a passageway for the separated oil from the accumulation region to the exterior of the separator-muffler. The separated gaseous refrigerant flows from the separator region and through the flow channels of varying cross-sectional areas, thereby inducing a noise reduction mechanism, and a gas outlet provides a passageway for the separated gaseous refrigerant to exit the separator-muffler.

18 Claims, 4 Drawing Sheets

OIL SEPARATOR AND MUFFLER STRUCTURE

BACKGROUND

The present invention relates generally to an oil separator-muffler for a compressor. More specifically, the present invention relates to an oil separator-muffler that separates oil from gaseous medium by impingement.

In a typical automotive air conditioning system, a mixture of oil and refrigerant enters the compressor through its suction port and is compressed through a reciprocating action of one or more pistons. The compressed, high-pressure refrigerant-oil mixture exits from the compressor through discharge ports to make its cyclic journey around the air conditioning system.

The aforementioned system is known as "oil in circulation." Although the oil is carried around the entire air conditioning system and lubricates the compressor upon entering the compressor as a mixture within the refrigerant, the compressor is the only component in the system that requires constant lubrication. Thus, as the oil refrigerant mixture circulates through the system, the oil coats on the tubes and fins of the condenser and evaporator. The presence of oil on the tubes and fins of the heat exchanger compromises the heat transfer efficiency of the system. Hence, the customer feels warmer air being discharged from the vehicle's registers. The oil that coats the heat exchanger is ultimately wasted because it does not cycle back to the compressor. With the advent of micro-channel heat exchangers, the likelihood that the oil will clog up the narrow tubes is more probable.

Moreover, in a clutchless compressor, the compressor never entirely shuts off. That is, instead of cycling off to prevent the flow of refrigerant, the compressor reduces its displacement and minimizes the flow. This type of compressor also features a check value, which prevents any undesired flow of refrigerant from entering the air conditioning system. Because the compressor has not cycled off, but has merely reduced its displacement volume, the internal components are still in motion and are therefore generating friction and heat. Hence, these components still require constant lubrication. This lubrication, however, is not available under such conditions with the conventional oil in circulation techniques. Thus, the compressor must rely on whatever oil has been retained within the compressor to lubricate the components. Because of the pumping action of the compressor, discharge side pressure pulsations are observed. These pressure pulsations lead to noise and compressor vibrations. There is therefore a need to control these pulsations for quieter compressor operation.

SUMMARY

In satisfying the above need, as well as overcoming the enumerated drawbacks and other limitations of the related art, the present invention provides an oil separator-muffler for a compressor. The oil separator-muffler has an inner chamber with an oil accumulation region and a wall positioned in the inner chamber. The wall defines a separator region and has an impingement surface. The arrangement of the wall in the inner chamber defines flow channels of varying cross-sectional areas. A mixture inlet for the separator-muffler provides a passageway for an oil gaseous refrigerant mixture to flow from the exterior of the separator-muffler into the separator region. The oil is separated from the mixture as the mixture impinges against the impingement surface and flows into the oil accumulation region. A channel in fluid communication with the oil accumulation region provides a passageway for the separated oil from the accumulation region to the exterior of the separator-muffler. The separated gaseous refrigerant flows from the separator region and through the flow channels of varying cross-sectional areas, and a gas outlet provides a passageway for the separated gaseous refrigerant to exit the separator-muffler.

Further features and advantages of this invention will become apparent from the following description, and from the claims.

DETAILED DESCRIPTION

Figure 1:
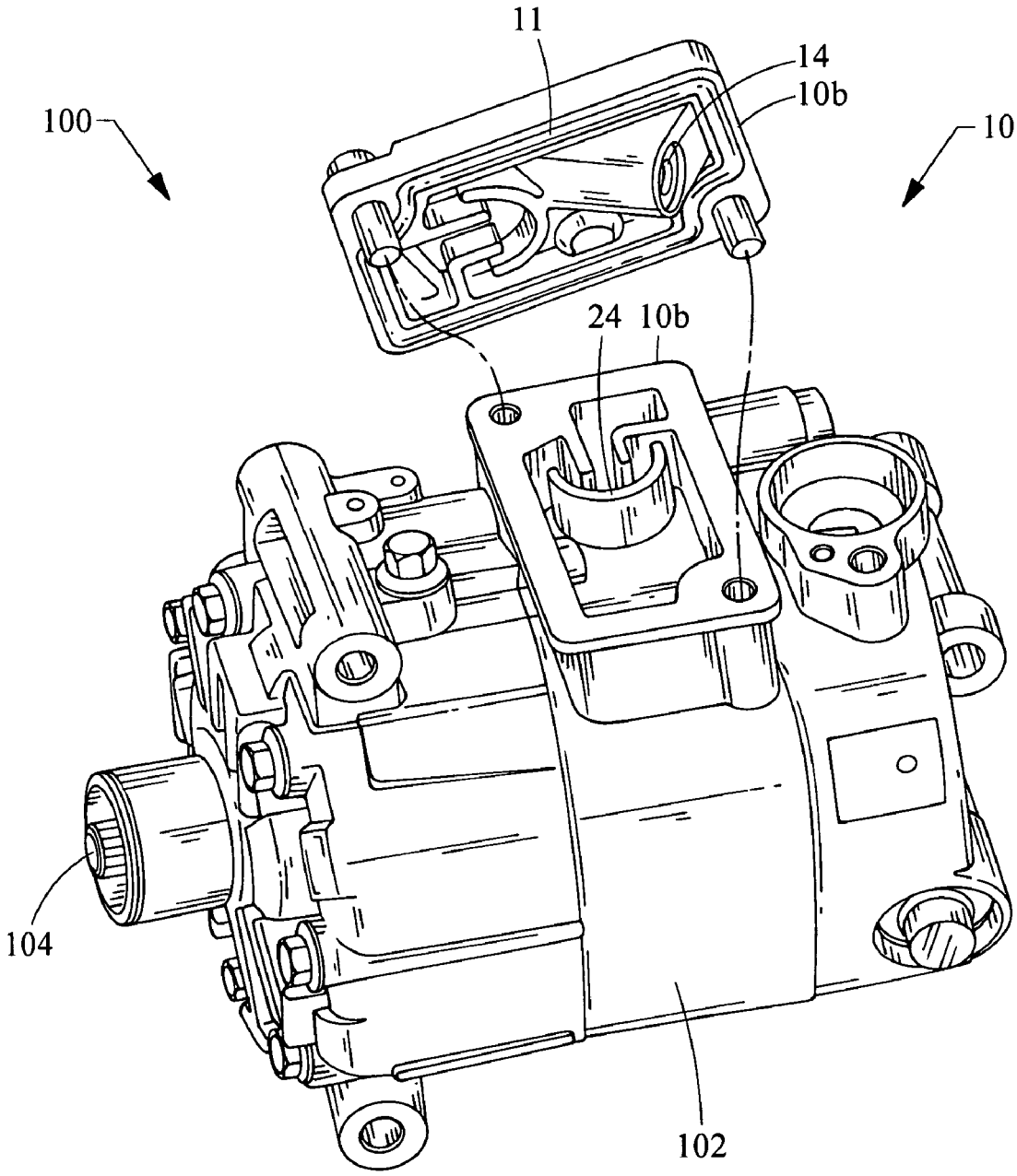
FIG. 1 is a perspective view of a swashplate compressor with an oil separator-muffler in accordance with an embodiment of the invention.
Figure 2:
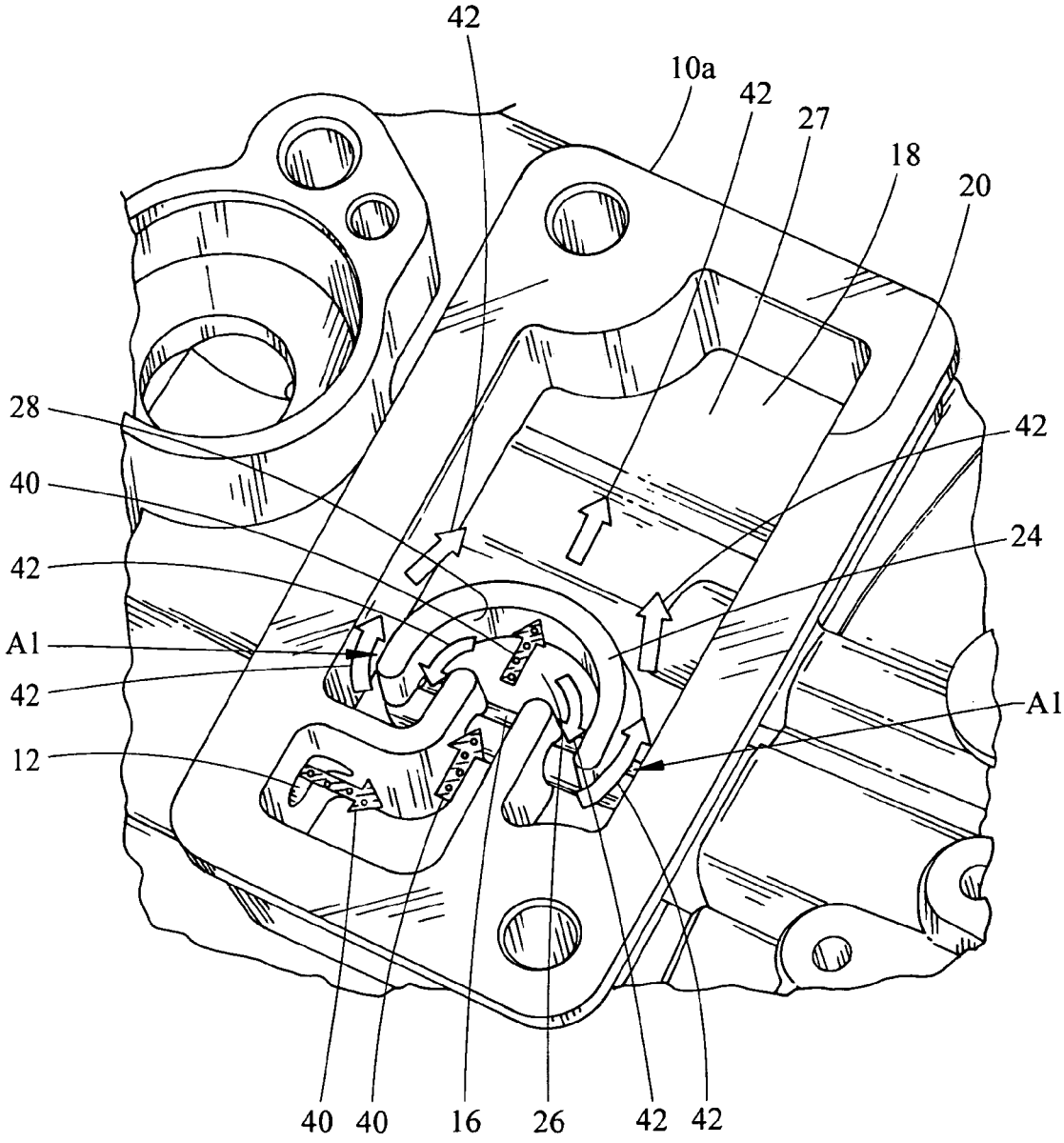
FIG. 2 is a closeup view of the separator-muffler.

Referring now to the drawings, an oil separator-muffler embodying the principles of the present invention is illustrated in FIGS. 1 and 2, and is generally designated at 10. The oil separator-muffler 10 includes a first portion 10*a* and a second portion 10*b* typically coupled to the first portion 10*a*, but shown separated from the first portion 10*a* for purposes of illustration. When portions 10*a* and 10*b* are coupled together, a gasket 11 located therebetween forms a seal to prevent inadvertent leakage from the inside of the separator-muffler 10.

The separator-muffler 10 further includes a mixture inlet 12, a gas outlet 14 and a wall 20 that defines an inner chamber 18. Inside the inner chamber 18 are an oil accumulation region or trough 16 and a substantially hemispherical wall 24 that defines a separator region 26 and an impingement surface 28. As used herein, the term "impingement" refers to the removal of suspended liquid droplets from a flowing stream of gas or vapor by a collision between the stream and a solid surface, such as the impingement surface 28. The collision forces the droplets to fall away from the stream.

The mixture inlet 12 is a passageway that provides communication between the exterior of the separator-muffler 10 and the inner chamber 18. For example, in some implementations, the mixture inlet 12 functions as a passageway between the separator-muffler 10 and a discharge outlet of a compressor to which the separator-muffler is associated such that an oil-refrigerant mixture 40 can enter into the separator-muffler 10.

As described in detail below, the separator-muffler 10 can be formed integrally with the housing of the compressor. The mixture inlet 12 can be an aperture in the wall 20 or it can be a tubular member that traverses the wall 20. The mixture inlet 12 can take any form of a communicative passageway suitable for providing access to the inner chamber 18 of the separator-muffler 10. In certain embodiments, the mixture inlet 12 is the same as the discharge outlet of the compressor. Ultimately, the size, shape, and form of the inlet 12 will depend on the characteristics of the discharge outlet of the compressor.

The gas outlet 14 provides a communicative passageway from the inner chamber 18, in particular, a region 27, to the external environment. For instance, the gas outlet 14 can provide a path through which a gaseous medium, such as a refrigerant 42, can leave the separator-muffler 10 and move onto a condenser after the oil has been separated from the refrigerant. The gas outlet 14 can be an aperture in the portion 10*b* or it can be a tubular member that traverses through the portion 10*b*, or it can be any other form of a communicative passageway suitable for providing the escape passageway for the gaseous medium.

The trough 16 provides a communicative passageway from the separator region 26. That is, the trough 16 functions as an escape passageway through which oil separated from an oil refrigerant mixture leaves the oil separator-muffler 10 to be circulated again through the compressor.

Figure 5:
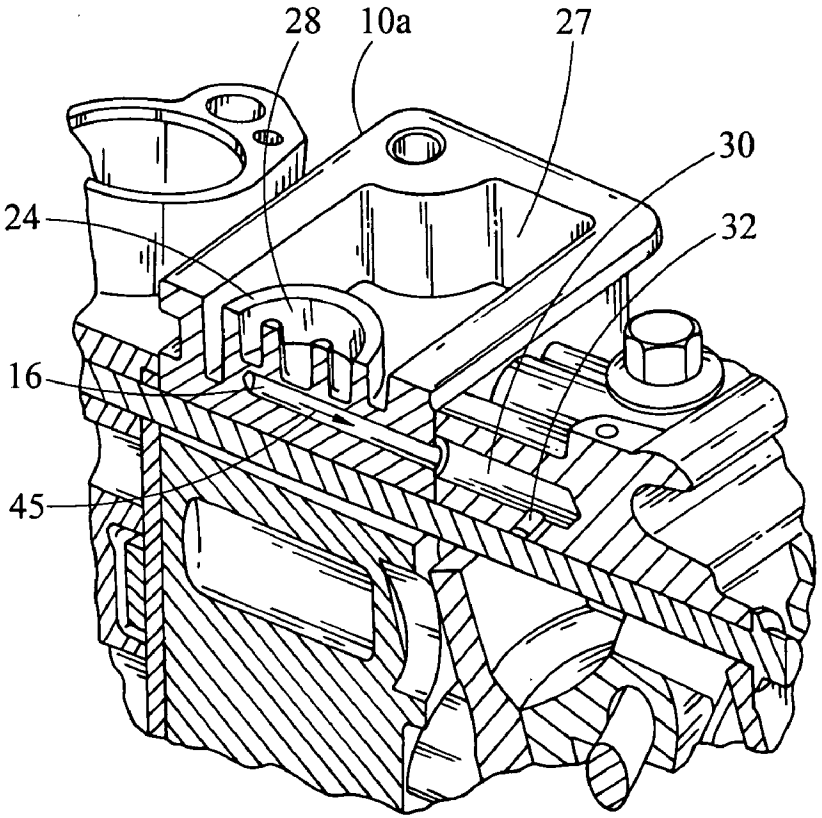
FIG. 5 is a cutaway view of the separator-muffler showing the flow of oil from the separator-muffler.

As shown in FIG. 5, in some implementations, the trough 16 is in communication with a channel 30 that terminates at an outlet 32. The channel can be an aperture in the wall 20, a tubular member that partially or fully traverses the wall 20 of the separator-muffler 10, or it can be any form of a communicative passageway suitable for providing the escape passageway for the separated oil.

The bottom of the trough 16 is located below the base of the separator region 26 such that oil 45 removed from the oil-refrigerant mixture flows down the surface 28, along the base of the separator region 26, and into the trough 16. The oil then flows from the trough 16 through the channel 30 and back into the compressor by way of the outlet 32.

Accordingly, oil is retained in the compressor, used, for example, in an air conditioning system, to provide constant lubrication to its internal components. This increased lubrication increases the compressor's durability and improves its efficiency. Consequently, the air conditioning system's overall efficiently significantly improves since less oil circulates and deposits onto the heat exchanger's fins and tubes, providing greater heat transfer and hence cooler discharge air through the vehicle's air conditioning registers.

Another particular feature of the separator-muffler 10 is that the wall 24 functions as a baffle. That is, the configuration of the substantially hemispherical wall 24 splits the flow of the refrigerant 42 and causes the refrigerant to change direction and to flow through narrow passageways A1 between the outer part of the wall 24 and the inner wall 20, and hence creates channels of varying cross-sectional areas through which the refrigerant 42 flows. These changes in the cross-sectional areas produce a muffler-like effect and therefore reduce noise from the separator-muffler 10. Specifically, the reduction in the flow areas of the channels or passageways of the separator-muffler 10 reduces discharge pressure pulsations (and hence NVH) caused by the pumping action of the associated compressor.

Figure 4:
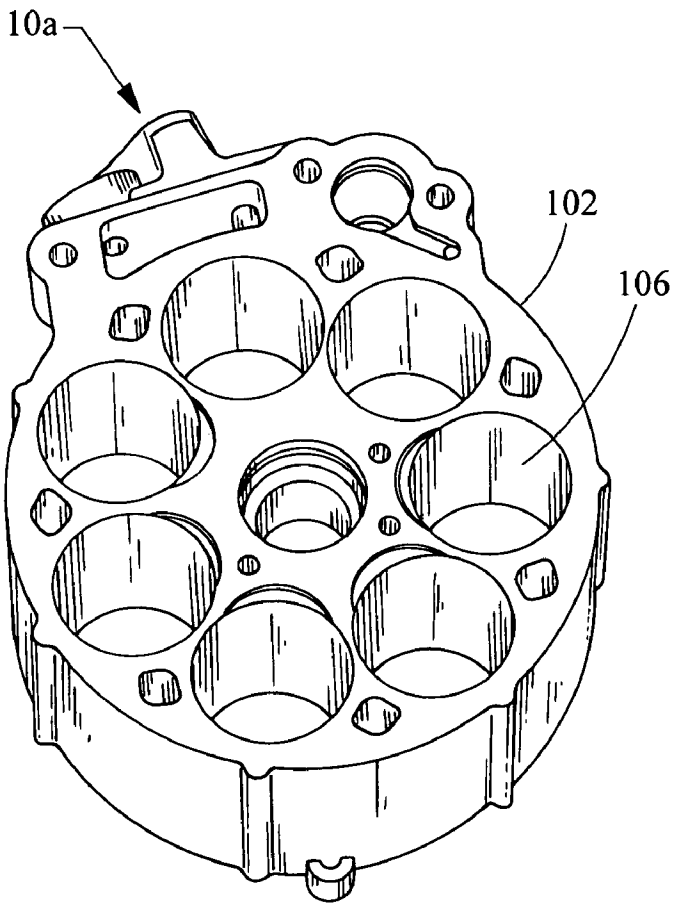
FIG. 4 is a view of the cylinders in the portion of the housing.
Figure 3:
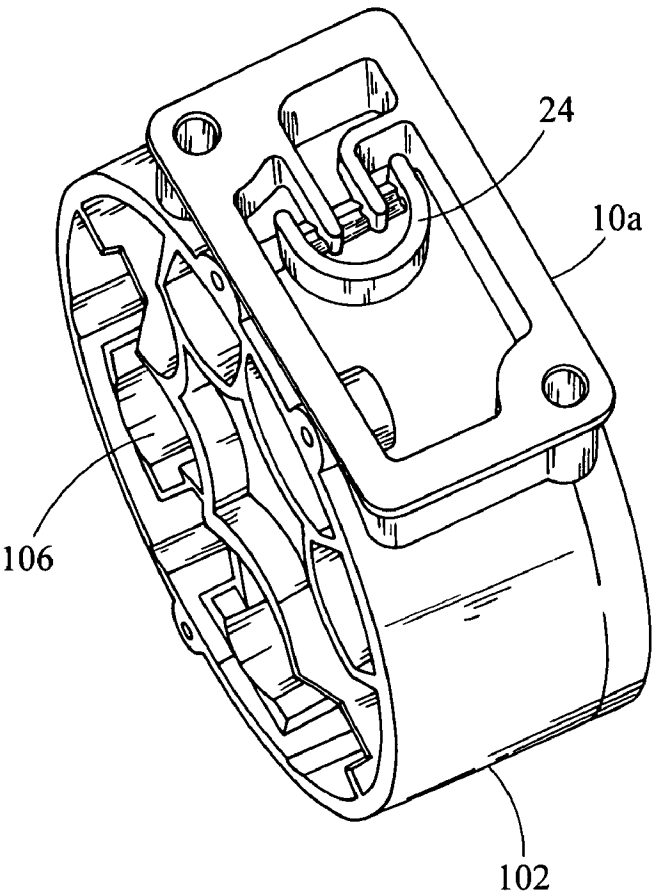
FIG. 3 is a perspective view of the separator-muffler and a portion of the housing of the compressor.

The oil separator-muffler 10 is particular well suited for incorporation into compressors in refrigeration circuits, such as swashplate compressors typically used in the air conditioning systems of automotive vehicles. An example of a swashplate compressor is shown in FIG. 1, and is generally designated at 100. The compressor 100 includes a housing 102 that defines a swashplate chamber and one or more cylinder bores 106 (FIGS. 3 and 4). A driveshaft 104 passes through the housing 102 and into the swashplate chamber. A swashplate is attached to the end of the shaft 104 at an angle within the chamber. Pistons are positioned in the cylinder bores 106, and via shoes, are connected to the swashplate such that the rotational movement of the shaft 104, and consequently the swashplate, forces the pistons to reciprocate in a linear manner within respective cylinder bores 106 as the pistons move between a top dead center position and a bottom dead center position.

A discharge outlet is in communication with each cylinder bore 106 such that the compressed oil-refrigerant mixture is forced out the discharge outlet into the oil separator-muffler 10 through the mixture inlet 12 (FIG. 2). The compression from the pistons also pushes the separated oil through the channel 30 and the refrigerant out of the separator-muffler 10 through the gas outlet 14. The refrigerant then flows into the remainder of the refrigeration circuit and the oil flows back to the compressor. The compressor 100 is provided with an oil return inlet for returning lubricating oil to the swashplate chamber such that it is available for lubricating the moving parts located within the swashplate chamber.

In this manner, the mixture 40 containing oil suspended in a gaseous refrigerant leaves the compressor 100 and enters the oil separator-muffler 10 through the mixture inlet 12. While in the oil separator-muffler 10, the mixture 40 impinges against the hemispherical surface 28 where the oil separates from the refrigerant gas 42 as described earlier. The refrigerant 42 leaves the oil separator-muffler 10 through the gas outlet 14 and is able to flow through the rest of the refrigeration circuit. The oil gradually accumulates in the trough 16, leaves the oil separator-muffler 10 through the channel 30, and returns to the compressor 100 through the outlet 32.

The oil separator-muffler 10 can be formed integrally with the housing 102 of the compressor 100. The communicative passageways between the compressor 100 and the mixture inlet 12, the gas outlet 14, and the trough 16 of the separator-muffler 10 can be integrally formed within the housing 102. Alternatively, these passageways 12, 14, and 16 can be separately attached members.

In various embodiments, the oil separator-muffler 10 can be formed from steel, aluminum, or any other suitable material by standard techniques, such as casting, stamping and welding, and connected to the compressor 100 with appropriate connections between the compressor 100 and the mixture inlet 12, the gas outlet 14, and the trough 16.

Figure 6:
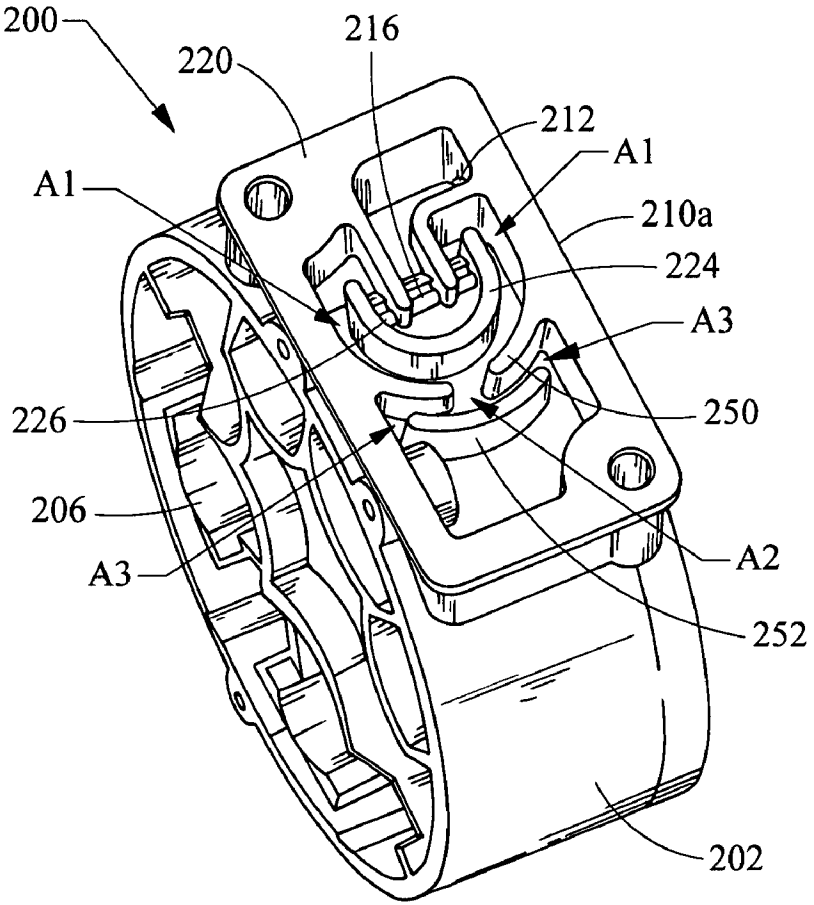
FIG. 6 is a perspective view of an alternative separator-muffler.

Multiple baffles may be used to enhance the noise reduction capabilities of a separator-muffler. For example, FIG. 6 shows a separator-muffler 200 formed integrally with a section of a housing 202 of a compressor. The separator-muffler 200 includes a portion 210*a* with a mixture inlet 212, a trough 216, and a separator region 226 defined by a wall 224. The separator-muffler 200 also includes another portion with a refrigerant outlet similar to the portion 10*b* with the outlet 14 described above. In addition to the wall 224, which functions as the primary baffle, the separator-muffler includes a curved two-wall baffle 250 and another single curved wall baffle 252. Accordingly, the outer parts of the wall 224 and the inside of the wall 220 define reduced area passageways A1, the ends of the two-wall baffle 240 define a reduced area passageway A2, and the outer parts of the baffle 252 and the inside of the wall 220 define reduced area passageways A3. Hence, after the refrigerant has been separated from the oil in the separator region 226, it flows though channels or passageways A1, A2, and A3, of varying cross-sectional areas defined by the configuration and arrangement of the walls 224, 250, and 252, which as described previously produces a muffler-like effect. While the lengths of the flow paths affect the frequency, changes in the cross-sectional areas controls the magnitude of the pressure pulsations.

Other embodiments are within the scope of the following claims.

What is claimed is:

1. An oil separator-muffler for a compressor, comprising:

a wall defining an inner chamber with an oil accumulation region;

a second wall positioned in the inner chamber, the second wall defining a separator region and having an impingement surface, the arrangement of the second wall in the inner chamber defining flow channels of varying cross-sectional areas;

a mixture inlet that provides a passageway for an oil gaseous refrigerant mixture to flow from the exterior of the separator-muffler into the separator region, the mixture inlet being oriented with respect to the second wall to cause the oil gaseous refrigerant mixture to impinge against the impingement surface separating the oil therefrom, the separated oil flowing into the oil accumulation region, the separated gaseous refrigerant flowing from the separator region and through the flow channels of varying cross-sectional areas;

a channel in fluid communication with the oil accumulation region, the channel defining a passageway for the separated oil from the accumulation region to the exterior of the separator-muffler; and a gas outlet defining a passageway for the separated gaseous refrigerant to exit the separator-muffler.

2. The separator-muffler of claim 1, wherein the mixture inlet and the gas outlet are apertures.

3. The separator-muffler of claim 1 wherein the flow channels of varying cross-sectional areas muffle noise generated by the compressor.

4. The separator-muffler of claim 1 wherein the oil accumulation region is a trough.

5. The separator-muffler of claim 1 wherein the bottom of the trough is positioned below the base of the separator region.

6. The separator-muffler of claim 1 wherein the impingement surface has a substantially hemispherical shape.

7. The separator-muffler of claim 1 further comprising a baffle with two curved walls.

8. The separator-muffler of claim 7 further comprising a baffle with a single curved wall, the baffle with two curved walls being positioned between the second wall and the baffle with two curved walls.

9. The separator-muffler of claim 8 wherein the arrangement of the baffles define further channels of varying cross-sectional areas.

10. The separator-muffler of claim 9 wherein the varying cross-sectional areas are reduced flow areas.

11. A compressor comprising:

a housing; and an oil separator-muffler, the oil separator-muffler including a first portion formed in the housing and a second portion that mates with the first portion to define an inner chamber with an oil accumulation region, the oil separator-muffler further including a wall positioned in the inner chamber, the wall defining a separator region and having an impingement surface, the arrangement of the wall in the inner chamber defining flow channels of varying cross-sectional areas; and a mixture inlet that provides a passageway for an oil gaseous refrigerant mixture to flow from the exterior of the separator-muffler into the separator region, the mixture inlet being oriented with respect to the wall to cause the oil gaseous refrigerant mixture to impinge against the impingement surface separating the oil therefrom, the separated oil flowing into the oil accumulation region, the separated gaseous refrigerant flowing from the separator region and through the flow channels of varying cross-sectional areas.

12. The compressor of claim 11 further comprising a channel in fluid communication with the oil accumulation region, the channel defining a passageway for the separated oil from the accumulation region to the exterior of the separator-muffler.

13. The compressor of claim 11 further comprising a gas outlet defining a passageway for the separated gaseous refrigerant to exit the separator-muffler.

14. The compressor of claim 11 wherein the impingement surface has a substantially hemispherical shape.

15. The compressor of claim 11 further comprising a baffle with two curved walls.

16. The compressor of claim 15 further comprising a baffle with a single curved wall, the baffle with two curved walls being positioned between the second wall and the baffle with two curved walls.

17. The compressor of claim 16 wherein the arrangement of the baffles define further channels of varying cross-sectional areas.

18. The compressor of claim 17 wherein the varying cross-sectional areas are reduced flow areas.

* * * * *